US005507229A

United States Patent [19]

Rogge et al.

[11] Patent Number: 5,507,229

[45] Date of Patent: Apr. 16, 1996

[54] PRINTING PRESS

[75] Inventors: Günter Rogge, Lienen; Uwe Rogge, Lengerich, both of Germany

[73] Assignee: Windmöller & Hölscher, Lengerich, Germany

[21] Appl. No.: 205,492

[22] Filed: Mar. 4, 1994

[30] Foreign Application Priority Data

Mar. 18, 1993 [DE] Germany ..... 43 08 712.4

[51] Int. Cl.[6] ..... B41F 35/00; B41L 41/00

[52] U.S. Cl. ..... 101/424.1; 101/416.1; 101/417; 101/425

[58] Field of Search ..... 101/424.1, 424.2, 101/416.1, 417, 425, 423

[56] References Cited

U.S. PATENT DOCUMENTS

| | | | |
|---|---|---|---|
| 2,565,570 | 8/1951 | Messinger | 101/424.1 |
| 2,593,595 | 4/1952 | Offen | 101/424.1 |
| 2,971,460 | 2/1961 | Shindle | 101/424.2 |
| 3,399,872 | 9/1968 | Dickerson | 101/424.2 |
| 4,434,562 | 3/1984 | Bubley et al. | 101/424.1 |
| 4,449,453 | 5/1984 | Staffer et al. | 101/424.1 |
| 4,920,881 | 5/1990 | Tafel | 101/424.1 |

FOREIGN PATENT DOCUMENTS

| | | | |
|---|---|---|---|
| 2608661 | 9/1977 | Germany | 101/424.1 |
| 3150833A1 | 7/1983 | Germany . | |
| 0136262 | 8/1984 | Japan | 101/424.1 |

*Primary Examiner*—Ren Yan
*Assistant Examiner*—Lynn D. Hendrickson
*Attorney, Agent, or Firm*—Keck, Mahin & Cate

[57] ABSTRACT

The invention concerns a printing press with several printing units arranged round an impression cylinder mounted in a frame, in which arrangement several gas blast devices for drying the web are arranged between the individual printing units. To allow the impression cylinder to be observed even in printing presses of a small size, the blasting devices are mounted for displacement on the frame in such a way that they can be displaced into and from a position at the side of the impression cylinder.

5 Claims, 2 Drawing Sheets

PRINTING PRESS

FIELD OF THE INVENTION

The invention relates to a printing press with several printing units arranged round an impression cylinder mounted in a frame, in which arrangement several blasting devices for drying the web are arranged between the individual printing units.

1. Prior Art

Such a printing press is known for example from DE-A-31 50 833 A1.

In suitably large printing presses, the printing operator can observe the impression cylinder in spite of the blasting devices arranged between the individual printing units, and hence can control the printing process. However, in printing presses of a very small size, this is no longer possible since the gap between the individual printing units is concealed by the corresponding blasting device.

2. Object of the Invention

It is therefore an object of the invention to develop such a printing press further, in such a way that observation of the impression cylinder is also possible without any great cost, even when the whole printing press is of a small size.

SUMMARY OF THE INVENTION

According to the present invention, we provide a printing press having several printing units arranged round an impression cylinder mounted in a frame, in which arrangement several gas blast devices for drying the web are arranged between the individual printing units, wherein the gas blast devices are mounted for displacement on the frame in such a way that they can be displaced into and from a position at the side of the impression cylinder. The gas blast devices are thus mounted for displacement in the frame in such a way that they can be displaced into a position at the side of the impression cylinder. Because of this, the printing operator can, when he wishes to observe the impression cylinder, simply push the gas blast device out of the position opposite the impression cylinder, so that it comes to lie in a position at the side of the impression cylinder. After a short visual check, he is able to push back the gas blast device into the operating position.

Each gas blast device may have connecting pipes which can be brought into engagement with a corresponding air feed pipe and an air evacuation pipe for feeding blast air and for evacuating solvent-enriched air.

Preferably each said gas blast device has at least one associated gasket for sealing the air path through said feed pipes with respect to atmosphere.

It is thus possible to close automatically the corresponding air supply line which is led out at the side of the printing press, simultaneously with the disengagement of the blasting device.

BRIEF DESCRIPTION OF THE DRAWINGS

Further details and advantages of the invention will be explained in greater detail with reference to an example of the preferred embodiment represented in the accompanying drawings, in which.

DETAILED DESCRIPTION OF THE PREFERRED EMBODIMENT

Figure 1:
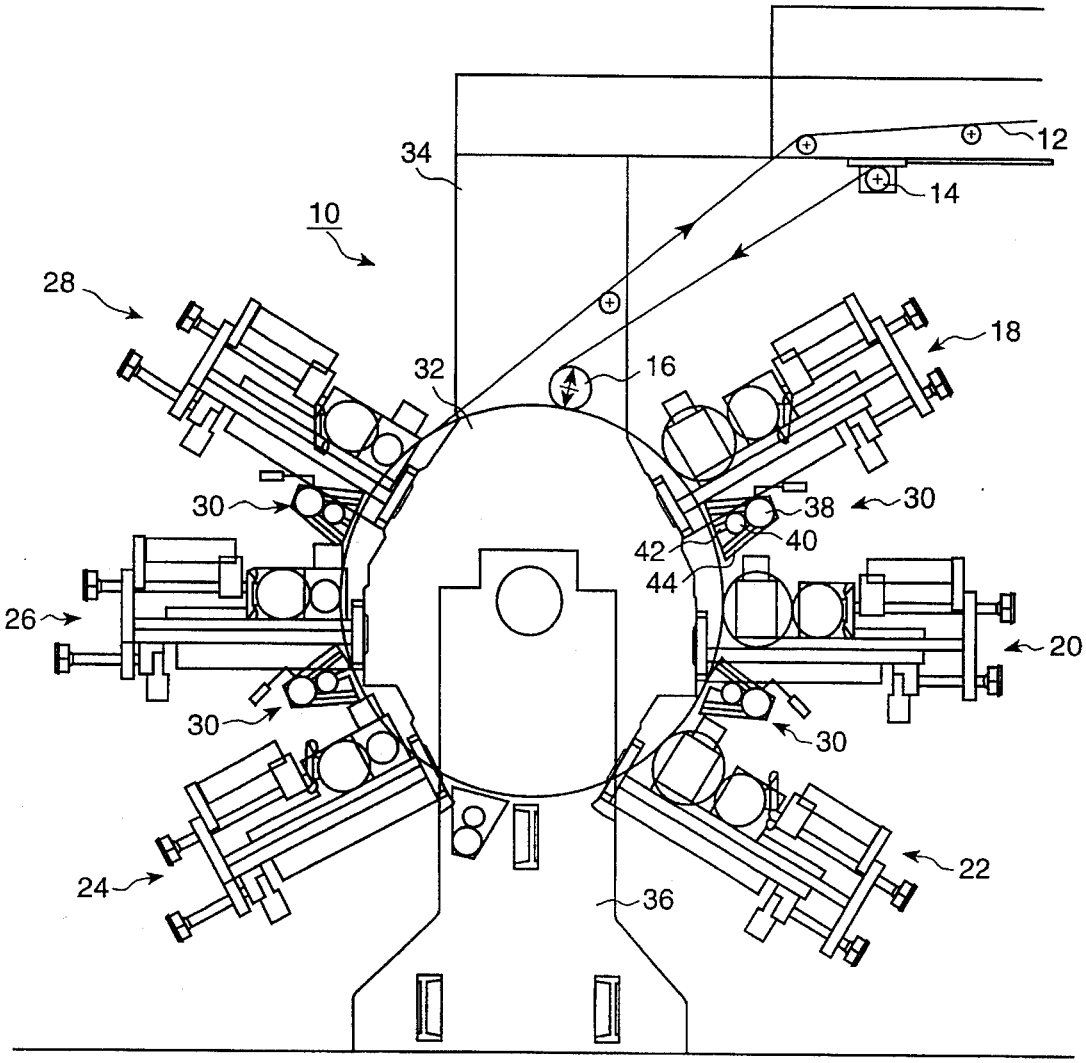
FIG. 1 is a section through a printing press with six printing units arranged around the periphery of the impression cylinder.

FIG. 1 shows a flexographic printing press 10 wherein a web 12 to be printed is fed to the impression cylinder 32 in the usual way over guide rollers 14, 16 and further guide rollers, not shown or designated, and is in turn moved away from the impression cylinder 32. The flexographic printing press 10 shown has six printing units 18, 20, 22, 24, 26, 28. Between these printing units, which are of a per se known design, there are arranged four blast drying devices 30 facing the impression cylinder 32. The impression cylinder is mounted in a frame which consists of an upper frame wall 34 and a lower frame wall 36.

Each of the individual blast drying devices 30 extends over the axial length of the impression cylinder 32 and has a trapezoidal shape in cross-section, as may be seen in FIG. 1. An air suction pipe 38 and an air feed pipe 40 are arranged inside the casing which has a trapezoidal shape in cross-section. The air feed pipe 40 has a blast air nozzle or duct 42 which is orientated in the direction towards the impression cylinder. The blast air striking the impression cylinder becomes enriched with solvents and then drawn off via the suction slots 44 which extend laterally along the casing and are connected to the suction pipe 38.

Figure 2:
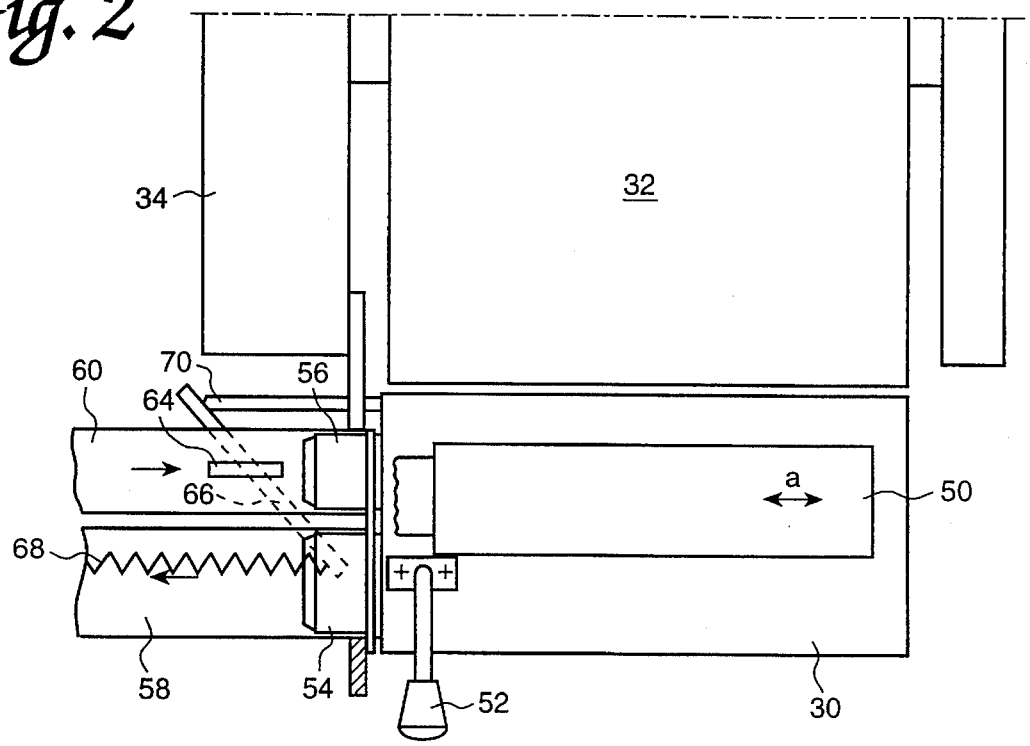
FIG. 2 is a partly sectioned side view of the printing press of FIG. 1, where the blasting device is arranged in the operating position.
Figure 3:
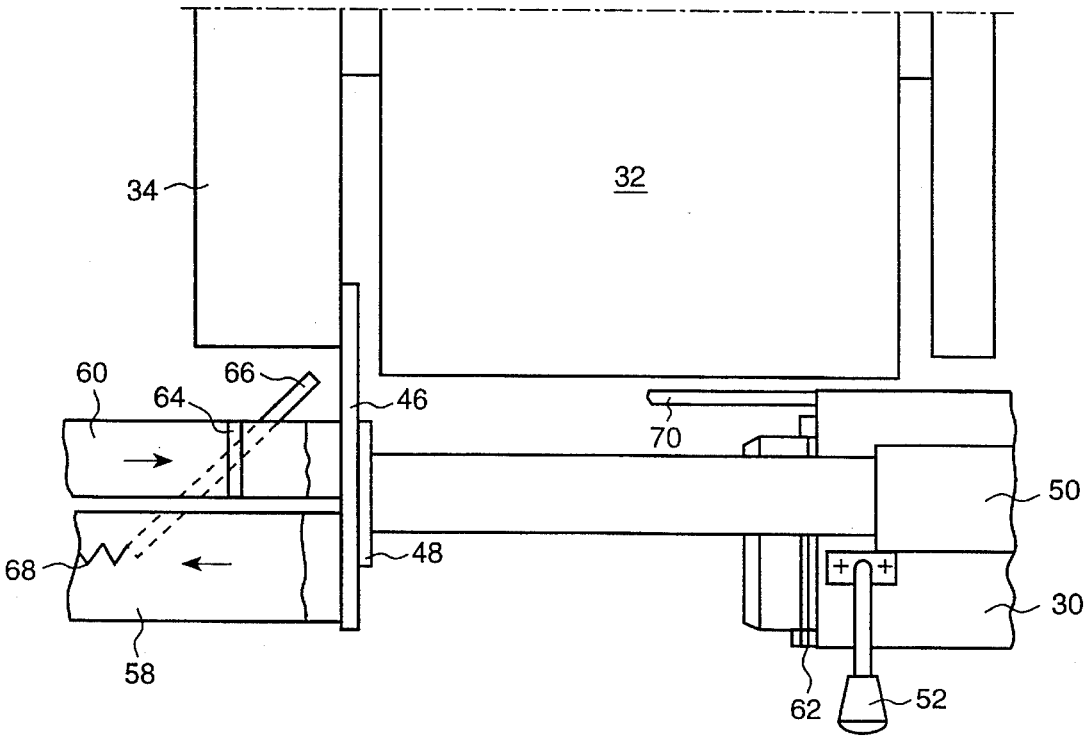
FIG. 3 is a representation corresponding to FIG. 2, where the blasting device is shown in the moved out position.

FIGS. 2 and 3, show how the blasting device 30 is mounted on the frame side wall 34. A support plate 46 is welded onto the frame side wall 34, on which plate there is attached in turn a supporting bar 48 which extends parallel to the impression cylinder 32. Along the supporting bar 48, the blast drying device 30 is mounted by means of a muff 50 for displacement in the direction of the double arrow a. In this arrangement, the blast drying device can be displaced by the printing operator by means of the handle 52.

In FIG. 2, the blast drying device 30 is shown in the operating position, and is connected to an air suction line 58 and air feed line 60 via suitable connecting sleeves, 54 for the drawn off air and 56 for the fed air. For securely sealing the blast drying device 30 relative to the air lines 58 and 60, a gasket 62 is provided as shown in FIG. 3. The air feed line 60 can be closed by a throttle valve 64 arranged therein. A lever 66, attached to the throttle valve, is biased by means of a tension spring 68 mounted at one of its ends. The other free end of the lever 66 can engage with a pin 70 fitted on the displaceable blast drying device 30.

The operation of the throttle valve 64 will become apparent from FIGS. 2 and 3.

In the operating position of the blast drying device 30, the throttle valve 64 is kept in its open position by abutment of a pin 70 against the free end of the lever 66. Thereby the spring-loaded end of the lever 66 is deflected to overcome the resilient biasing force of the spring 68. If the blast drying device 30 is now moved out into a laterally displaced position, as shown in FIG. 3, the pin 70 is also displaced so that, because of the resilient force of the spring 68, the lever 66 and thereby the throttle valve 64 are pivoted so as to close the throttle valve. Intake of the blast air from the air feed line 60 is thereby effectively prevented.

The Figures do not show that, for reasons concerning operator safety at work, side plates may be provided at the sides of the blast drying devices, wherein flap doors have to be provided through which the blast drying devices 30 can be displaced outwards into a position at the side of the impression cylinder.

We claim:

1. A printing press comprising a frame, an impression cylinder mounted in said frame, a plurality of printing units arranged around said impression cylinder and a plurality of gas blasting devices for drying a web with one of said gas blasting devices positioned between each successive pair of printing units, said printing press having an air feed pipe for feeding blast air and an air evacuation pipe for evacuating solvent-enriched air and a plurality of bars extending parallel to said impression cylinder, each of said gas blasting devices being mounted on one of said bars for movement between an operating position in which said gas blasting devices are positioned adjacent said impression cylinder and a second position in which said gas blasting devices are positioned laterally past said impression cylinder, said gas blasting devices being provided with pipes for connection with said air feed pipe and said air evacuation pipe only when said gas blasting devices are in said operating position, wherein said gas blasting devices may be moved to said second position to disconnect from said air feed pipe and said air evacuation pipe and provide unobstructed access to said impression cylinder.

2. A printing press according to claim 1, wherein each of said bars is connected to the frame by a supporting plate.

3. A printing press according to claim 1, wherein each said gas blasting device comprises at least one associated gasket for sealing an air path through said air feed pipe and said air evacuation pipe.

4. A printing press according to claim 1, further comprising a throttle valve for closing the air feed pipe, a lever for operating the throttle valve, a tension spring for biasing a first free end of said lever, and a pin fitted on the gas blasting devices for being brought into engagement with a second free end of the lever.

5. A printing press according to claim 1, further comprising a manipulating handle attached to each gas blasting devices.

* * * * *